US006799948B2

(12) United States Patent
Ito et al.

(10) Patent No.: US 6,799,948 B2
(45) Date of Patent: Oct. 5, 2004

(54) BLADE OF A GAS TURBINE

(75) Inventors: Eisaku Ito, Hyogo (JP); Kazuo Uematsu, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 108 days.

(21) Appl. No.: 09/973,009

(22) Filed: Oct. 10, 2001

(65) Prior Publication Data

US 2002/0094276 A1 Jul. 18, 2002

(30) Foreign Application Priority Data

Jan. 12, 2001 (JP) ..... 2001-005723

(51) Int. Cl.[7] ..... F01D 5/14
(52) U.S. Cl. ..... 416/223 A
(58) Field of Search ..... 416/223 A, 243, 416/DIG. 2, DIG. 5, 97 R; 415/191, 208.1, 208.2

(56) References Cited

U.S. PATENT DOCUMENTS 1,749,528 A * 3/1930 De Freudenreich et al. 416/248
3,140,042 A * 7/1964 Noriyoshi ..... 416/243
3,192,719 A * 7/1965 Kronogard ..... 415/914
4,165,950 A * 8/1979 Masai et al. ..... 416/178
4,626,174 A * 12/1986 Sato et al. ..... 416/223 A
4,786,233 A * 11/1988 Shizuya et al. ..... 416/97 R

FOREIGN PATENT DOCUMENTS

| | | |
|---|---|---|
| CZ | 278 005 B6 | 5/1993 |
| EP | 0 937 862 A2 | 8/1999 |
| GB | 1067169 | 5/1967 |
| JP | 57-171006 | 10/1982 |
| JP | 11-173104 | 6/1999 |
| JP | 11-200802 | 7/1999 |

* cited by examiner

*Primary Examiner*—Edward K. Look
*Assistant Examiner*—Igor Kershteyn
(74) *Attorney, Agent, or Firm*—Oblon, Spivak, McClelland, Maier & Neustadt, P.C.

(57) ABSTRACT

The blade has such a shape that the diameters of circles inscribing the belly and back sides at different positions of adjacent blades decreases as one goes from the front edge to the rear edge. Since the blade has such a shape, even if the influent angle and effluent angle of gases are increased, a deceleration passage is not formed in the passage between the adjacent moving blades.

3 Claims, 11 Drawing Sheets

BLADE OF A GAS TURBINE

FIELD OF THE INVENTION

The present invention relates to a blade, of a gas turbine, having a wide turning angle and suitable to a heavy duty and high load gas turbine.

BACKGROUND OF THE INVENTION

General blades of a gas turbine will be explained by referring to FIG. 7 to FIG. 12. A gas turbine generally comprises plural stages of stationary blades disposed annularly in a casing (blade ring or chamber), and plural stages of moving blades 1 disposed annularly in a rotor (hub or base). Two adjacent moving blades 1 are shown in FIG. 7.

The moving blade 1 is composed, as shown in FIG. 7, of a front edge 2, a rear edge 3, and a belly (or a belly side) 4 and a back (or a back side) 5 linking the front edge 2 and rear edge 3. Combustion gases G1, G2, as shown in FIG. 7, flow in a passage 6 between the belly 4 and back 5 of two adjacent moving blades 1 at an influent angle α1 (G1), and turn and flow out at an effluent angle α2 (G2). By the flow of combustion gases G1, G2, the rotor rotates in a direction of blank arrow U through the moving blades 1.

The width of the passage 6 ("passage width") of the moving blades 1 in which the combustion gases G1, G2 flow gradually decreases from the front edge 2 to the rear edge 3 as indicated by solid line curve in FIG. 8. At the rear end 3, the width is minimum, that is, throat O. Thus, by narrowing the passage width between the moving blades 1, along the direction of flow of the combustion gases G1 and G2, the combustion gases G1 and G2 are expanded and accelerated, and the turbine efficiency is enhanced.

Recently, in the field of gas turbine, the mainstream is the gas turbine of high load with the pressure ratio of 20 or more and the turbine inlet gas temperature of 1400 degree centigrade or more.

As the gas turbine of high load, the following two types are known. One is a high load gas turbine in which there are a large number, for example, from four to five, of blades. The other is a high load gas turbine in which the work of each blade of each stage is increased without increasing the number of stages of blades, for example, remaining at four stages. Of these two high load gas turbines, the latter high load gas turbine is superior in the aspect of the cost performance.

To increase the work ΔH of each blade in each stage, it is required to increase the blade turning angle Δα as shown in FIG. 9 and FIG. 10, and equations (1) and (2).

$$\Delta H = U \times \Delta V\theta \quad (1)$$

$$\Delta V\theta = V\theta 1 + V\theta 2 \quad (2)$$

In equations (1) and (2), only the peripheral speed component Vθ is defined in the absolute system, and the other peripheral speed components are defined in the relative system.

More specifically, symbol U denotes the peripheral speed of moving blade 1. The peripheral speed U of moving blade 1 is almost constant, being determined by the distance from the center of rotation of the rotor and the tip of the moving blade 1, and the rotating speed of the rotor and moving blade 1. Accordingly, to increase the work ΔH of each blade in each stage, it is first required to increase the difference ΔVθ between the peripheral speed components near the inlet of the combustion gas G1 and outlet of the combustion gas G2.

To increase the difference ΔVθ between the peripheral speed components, it is required to increase the peripheral speed component Vθ1 near the inlet of the combustion gas G1, and the peripheral speed component Vθ2 near the outlet of the combustion gas G2.

When the peripheral speed component Vθ1 near the inlet of the combustion gas G1 is increased, the influent angle α1 becomes larger. When the peripheral speed component Vθ2 near the outlet of the combustion gas G2 is increased, the effluent angle α2 becomes larger. When the influent angle α1 and effluent angle α2 become larger, the turning angle Δα becomes larger (see FIG. 10). As a result, when the turning angle Δα is increased, the work ΔH of each blade in each stage becomes larger.

Accordingly, as shown in FIG. 11 and FIG. 12, by setting the influent angle α3 and effluent angle α4 larger than the influent angle α1 and effluent angle α2 shown in FIG. 7, it may be considered to increase the turning angle Δα1 larger than the turning angle Δα shown in FIG. 10.

However, the following problems occurs when only the influent angle α3 and effluent angle α4 are set larger. That is, the passage width becomes the passage width as indicated by single dot chain line curve shown in FIG. 8.

As a result, as shown in FIG. 8, a maximum width 7 occurs at a position behind the front edge 2, and a minimum width 8 occurs at a position ahead of the rear edge 3, that is, a width smaller than throat O is formed. Therefore, as indicated by single dot chain line curve, a deceleration passage (diffuser passage) is formed from the front edge 2 to the maximum width 7, and from the minimum width 8 to the rear edge 3. Accordingly, the flow of the combustion gases G1, G2 is decelerated, and the turbine efficiency loss increases.

Thus, if only the blade turning angle is increased, the gas turbine with such blades is not suited to the heavy duty and high load. The problem is the same in the stationary blades as well as in the moving blades 1.

SUMMARY OF THE INVENTION

It is an object of the invention to present a blade, of a gas turbine, having a wide turning angle and suitable to a heavy duty and high load gas turbine.

The blade, according to the present invention, has such a shape that the diameters of circles inscribing the belly and back sides at different positions of adjacent blades decreases as one goes from the front edge to the rear edge. Since the blade has such a shape, even if the influent angle and effluent angle of gases are increased, a deceleration passage is not formed in the passage between the adjacent moving blades.

Other objects and features of this invention will become apparent from the following description with reference to the accompanying drawings.

DESCRIPTION OF THE PREFERRED EMBODIMENTS

Figure 1:
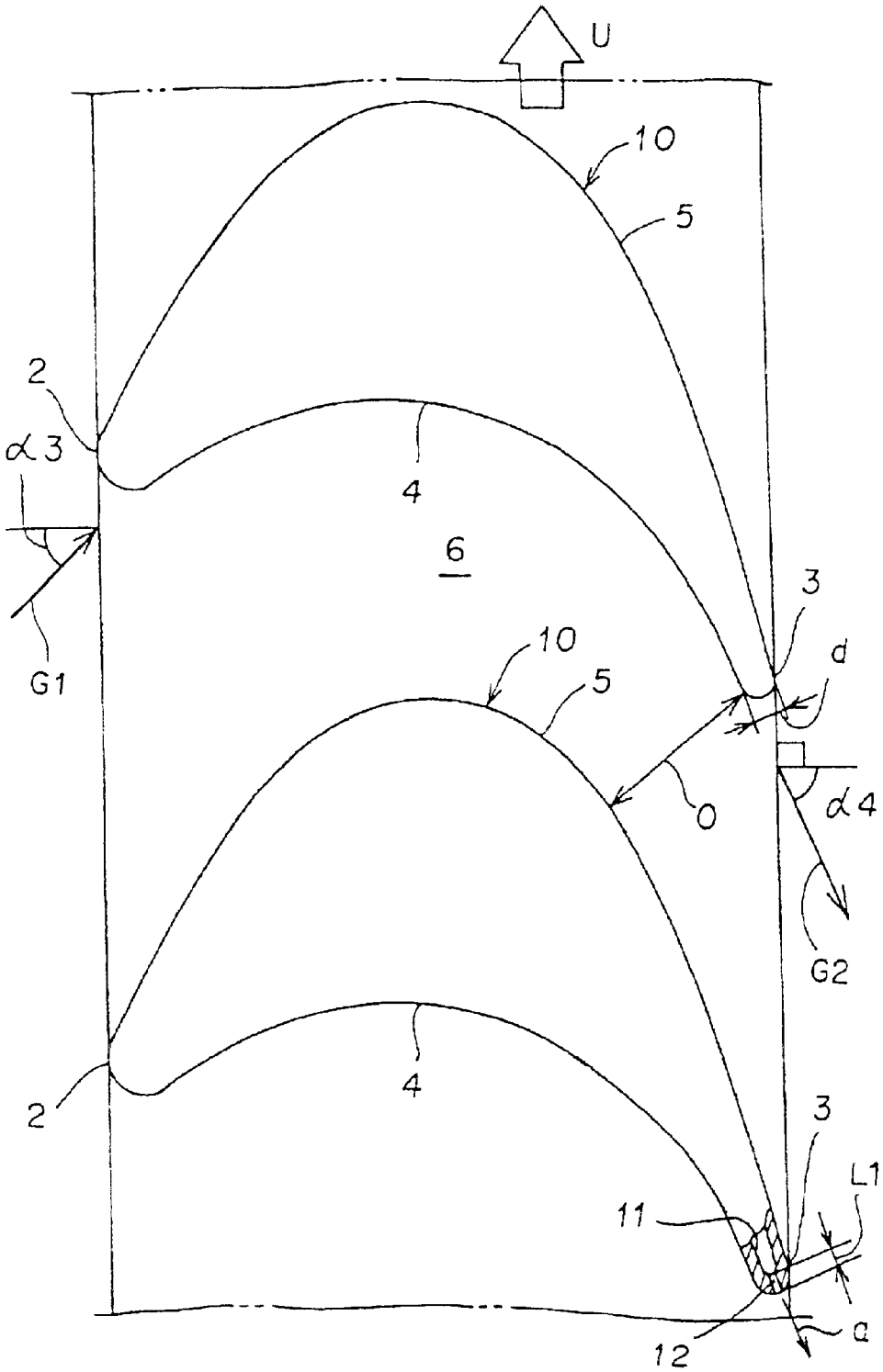
FIG. 1 is an explanatory diagram of influent angle, effluent angle, throat, rear edge wall thickness, and distance from cooling passage to rear edge in the hub of moving blades in a first embodiment of blade according to the present invention.

Embodiment of the blade of the gas turbine according to this invention will be explained by referring to FIG. 1 to FIG. 6. It must be noted, however, that the invention is not limited to this embodiment alone. In the drawings, same parts as in FIG. 7 to FIG. 12 are identified with same reference numerals.

The blade of the embodiment, that is, the moving blade 10 is large in the influent angle $\alpha$3 and effluent angle $\alpha$4, and also large in the turning angle $\Delta\alpha$1. For example, the effluent angle $\alpha$4 is about 60 to 70 degrees, and the turning angle $\Delta\alpha$1 is about 115 to 150 degrees. Since the moving blade 10 has wider turning angle $\Delta\alpha$1 (than the conventional one), this blade is ideal and suited for the heavy duty and high load gas turbine.

Figure 2:
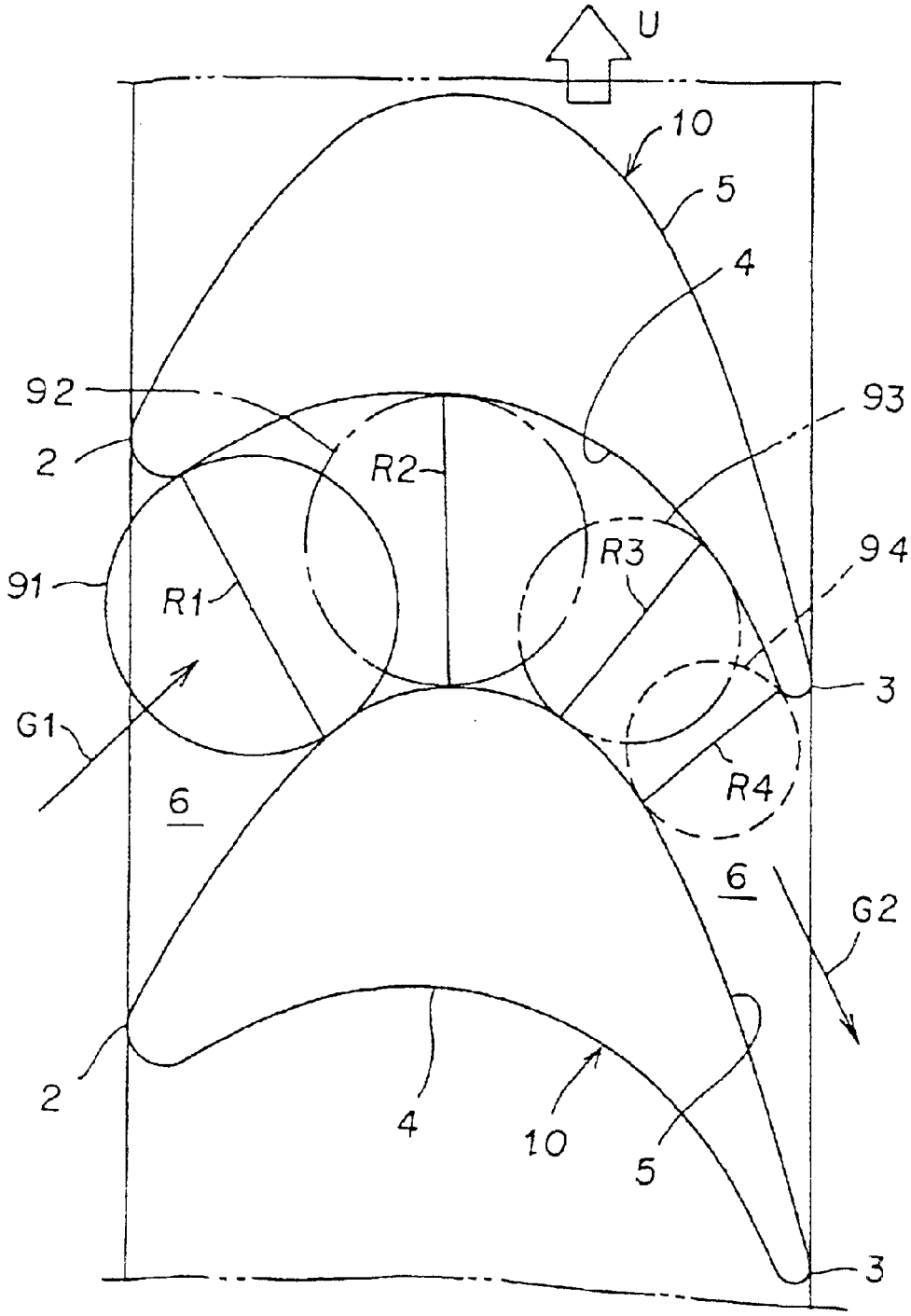
FIG. 2 is an explanatory diagram of showing a passage of which diameter of inscribed circle of belly and back of adjacent blades gradually decreases from front edge to rear edge of the same.

In the moving blade 10, as shown in FIG. 2, diameters R1, R2, R3, and R4 of inscribed circles 91, 92, 93, and 94 of the belly 4 and back 5 of adjacent moving blades 10 are designed to be smaller from the front edge 2 to the rear edge 3.

That is, the passage 6 is formed in the relation of diameter R1 of solid line inscribed circle 91 (circle inscribing at front edge 2)>diameter R2 of single-dot chain line inscribed circle 92>diameter R3 of double-dot chain line inscribed circle 93>diameter R4 (throat O) of broken line inscribed circle 94 (circle inscribing at rear edge 3).

The moving blades 10 of the embodiment are thus composed, and if the influent angle $\alpha$3 and effluent angle $\alpha$4 are increased, deceleration passage is not formed in the passage 6 between adjacent moving blades 10. Therefore, the moving blades 10 of the embodiment present moving blades ideal for a gas turbine of large turning angle $\Delta\alpha$1, heavy work, and high load.

Figure 5:
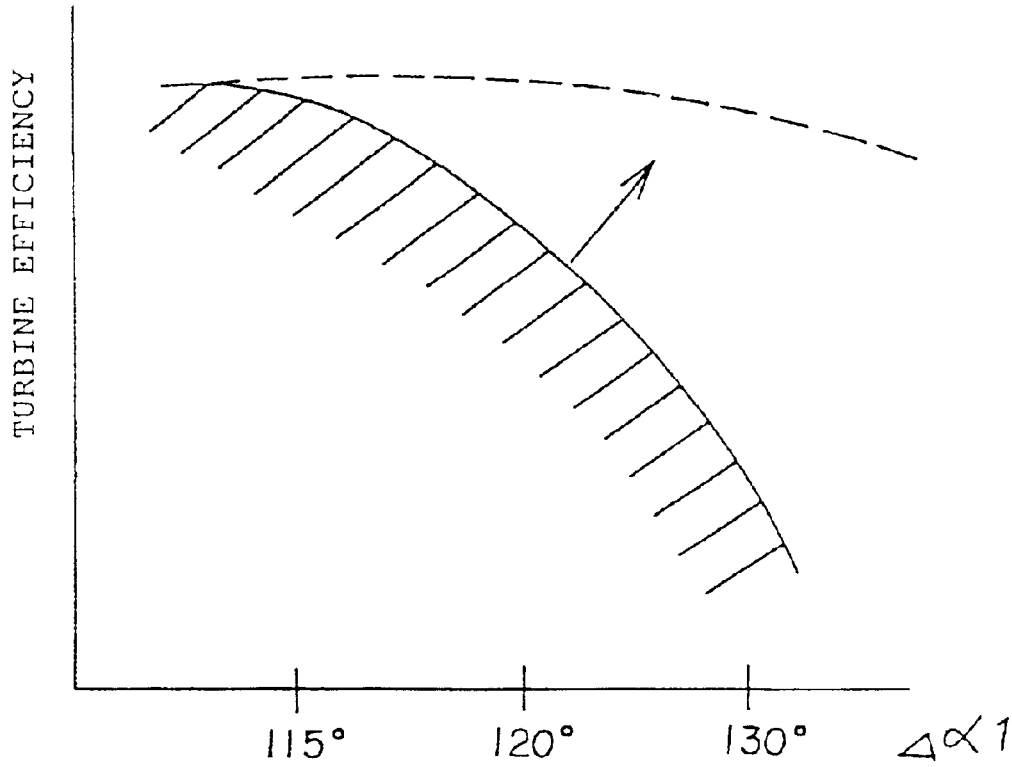
FIG. 5 is a graph showing the relation of turbine efficiency and turning angle in the blade of Gas turbines of the invention and the conventional blade of Gas turbines.

A comparison of the efficiency of the conventional blades (moving blades 1) and the moving blades 10 of the embodiment will be undertaken by referring to FIG. 5. That is, in case of the conventional blade, as indicted in the shaded area enclosed by solid line curve in FIG. 5, when the turning angle $\Delta\alpha$1 is more than about 115 degrees, the turbine efficiency drops suddenly. On the other hand, in the moving blades 10 of the embodiment, as indicated by broken line in FIG. 5, even if the turning angle $\Delta\alpha$1 is more than about 115 degrees, a high turbine efficiency is maintained.

Figure 3:
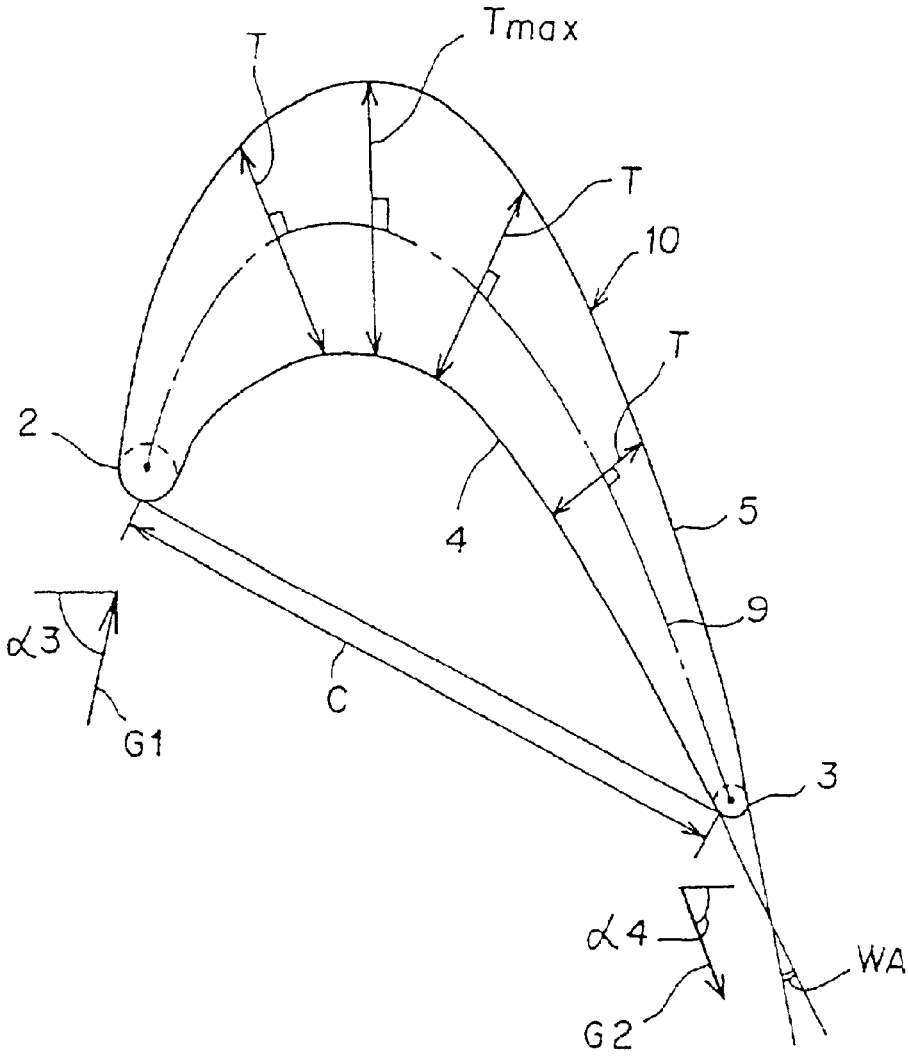
FIG. 3 is an explanatory diagram showing wall thickness, maximum wall thickness, blade chordal length, wedge angle, camber line, influent angle, and effluent angle of the same.

FIG. 3 is an explanatory diagram showing a specific configuration of the moving blade 10. In this blade, the turning angle $\Delta\alpha$1 is about 115 to 150 degrees. The ratio Tmax/C of maximum wall thickness Tmax of moving blade 10 and blade chordal length C is about 0.15 or more. The wedge angle WA of the rear edge of the moving blade 10 is about 10 degrees or less.

The manufacturing process (design process) of the moving blade 10 is explained by referring to FIG. 3. First, the influent angle $\alpha$3 and effluent angle $\alpha$4 are determined. Along the turning angle $\Delta\alpha$1 determined from the influent angle $\alpha$3 and effluent angle $\alpha$4, a camber line 9 is determined. Then the wedge angle WA of the rear edge is determined. The wall thickness T and Tmax of the moving blade 10 are determined. As a result, the moving blade 10 can be manufactured.

Figure 4A:
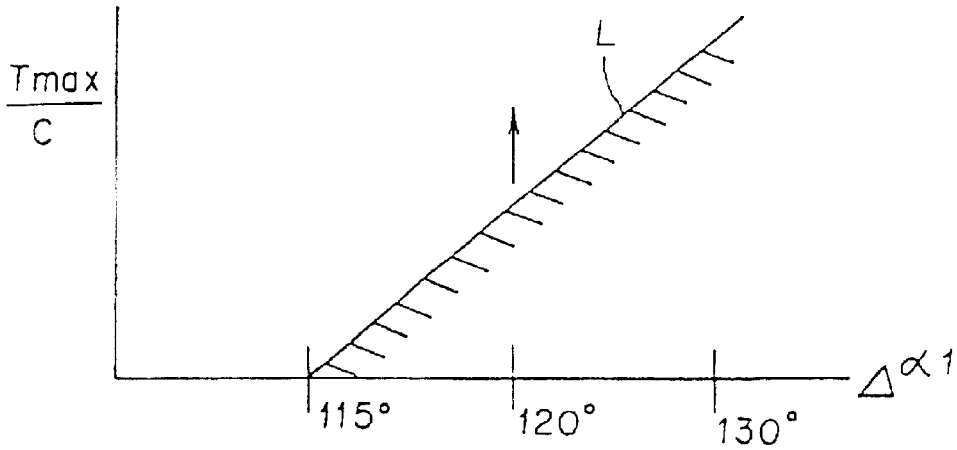
FIG. 4A is a graph showing characteristic of Tmax/C.
Figure 4B:
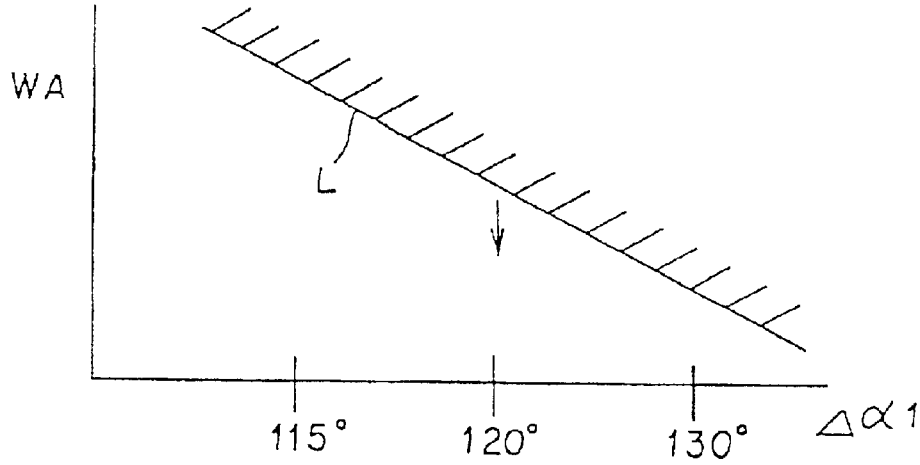
FIG. 4B is a graph showing characteristic of WA.

The ratio Tmax/C of maximum wall thickness Tmax of moving blade 10 and blade chordal length C is about 0.15 or more in an area at the arrow direction side from straight line L in the characteristic condition shown in the graph in FIG. 4A. The wedge angle WA of the rear edge of the moving blade 10 is about 10 degrees or less in an area at the arrow direction side from straight line L in the characteristic condition shown in the graph in FIG. 4B.

Figure 8:
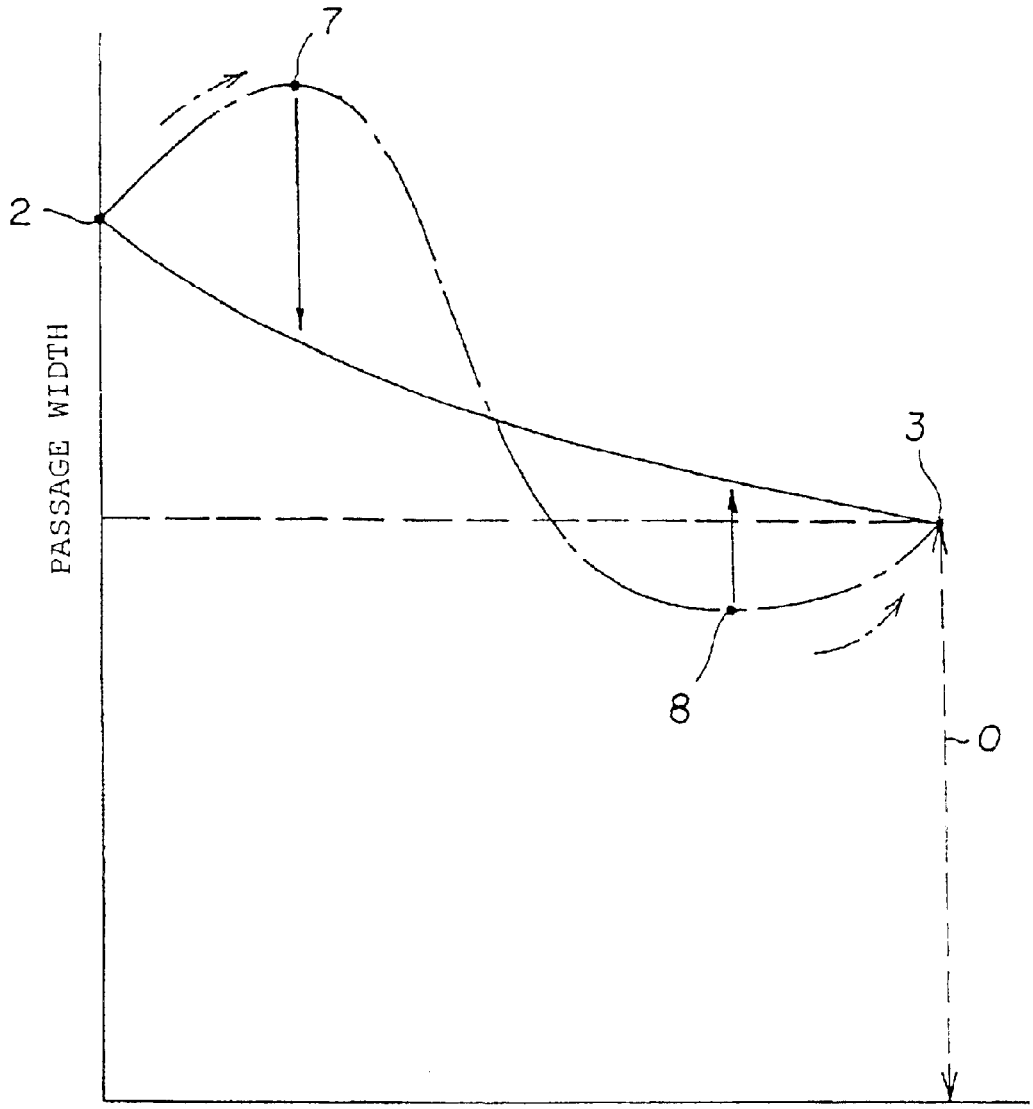
FIG. 8 is a graph showing an ideal passage width and an inappropriate passage width.
Figure 9:
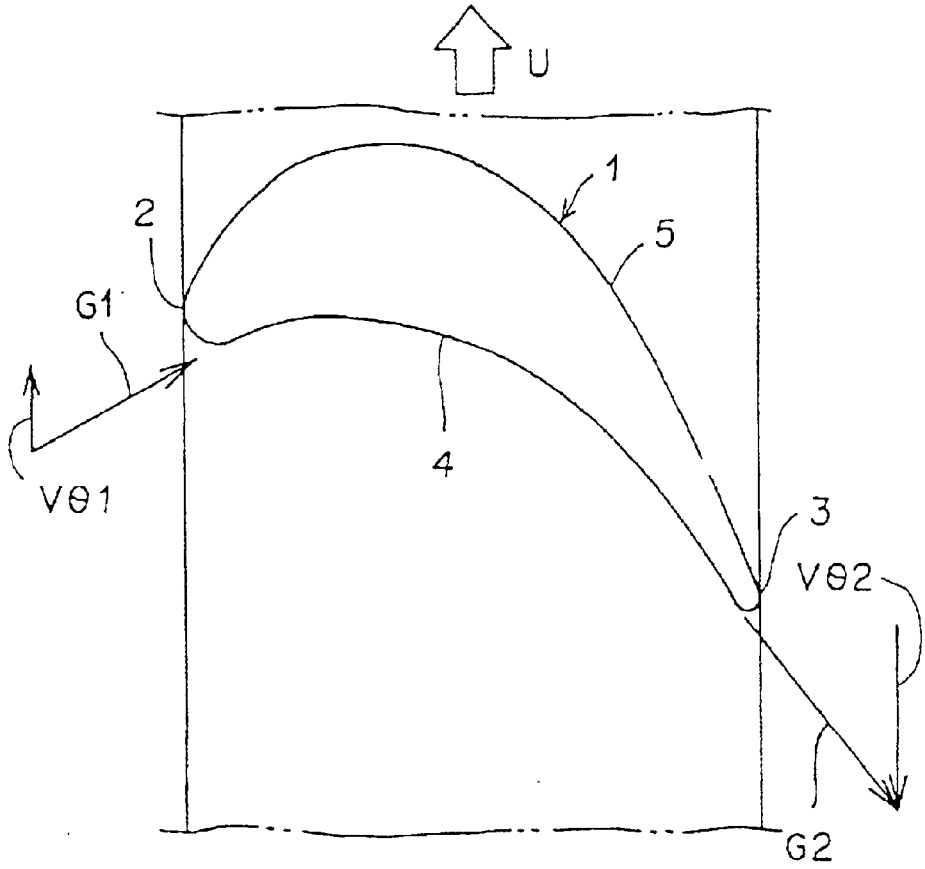
FIG. 9 is an explanatory diagram showing direction of influent side combustion gas and direction of effluent side combustion gas.
Figure 10:
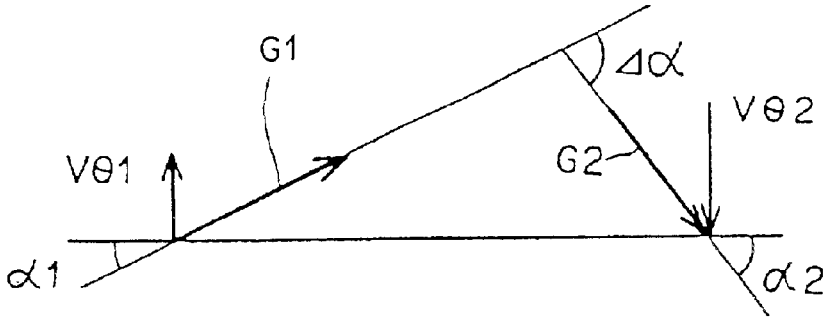
FIG. 10 is an explanatory diagram showing the turning angle.
Figure 11:
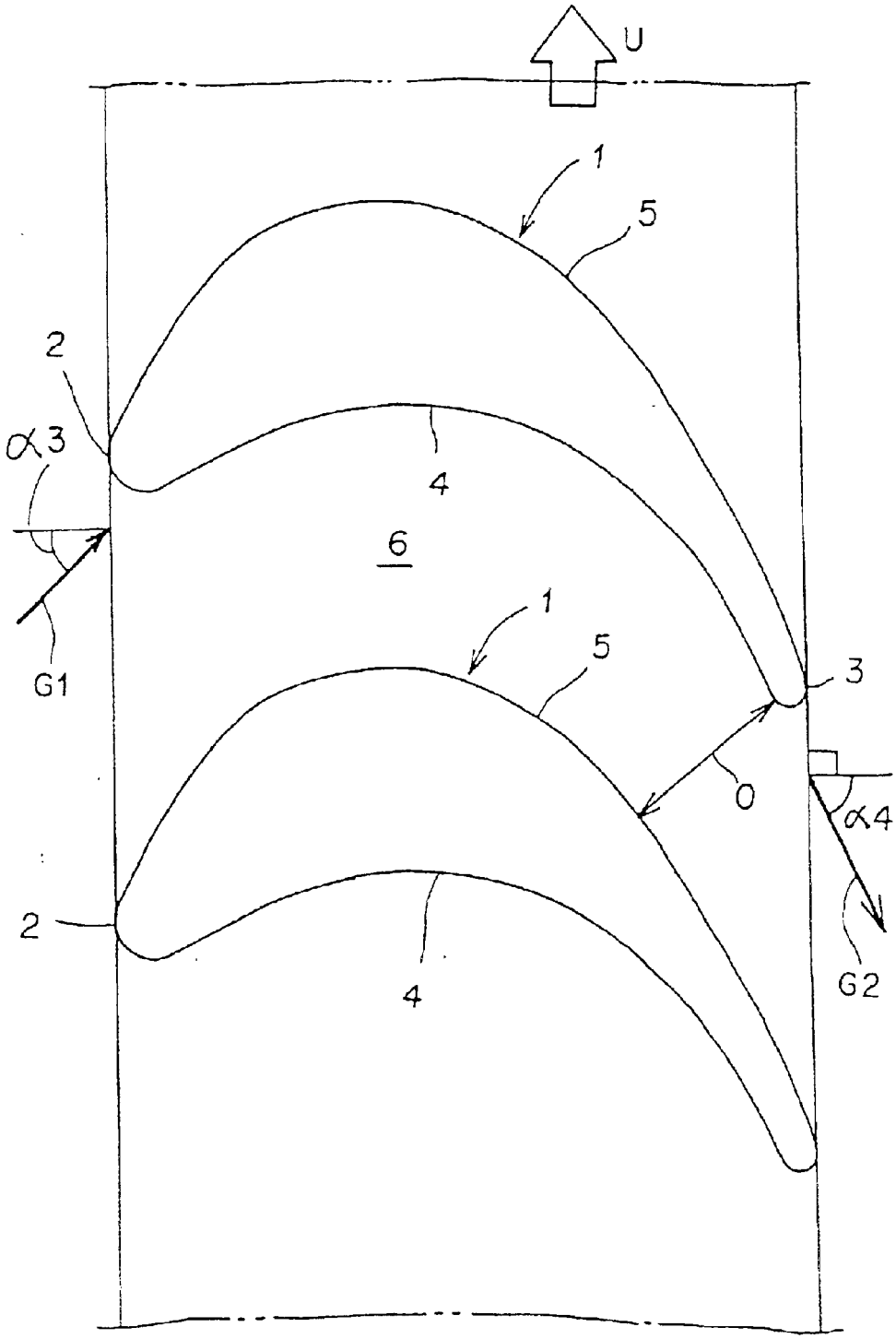
FIG. 11 is an explanatory diagram of a case with an increased turning angle.
Figure 12:
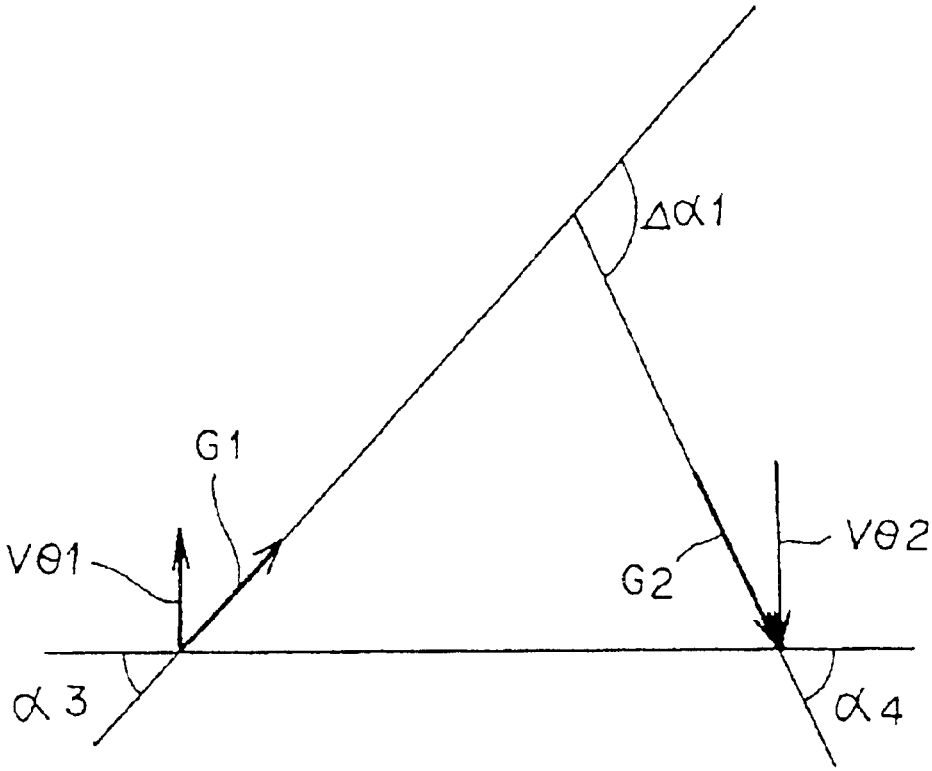
FIG. 12 is an explanatory diagram showing an increased turning angle.

When these two characteristic conditions are satisfied, the passage 6 indicated by solid line in FIG. 8 (as shown in FIG. 2, the passage 6 gradually decreased in diameters R1, R2, R3, and R4 of inscribed circles 91, 92, 93, and 94 of the belly 4 and back 5 of adjacent moving blades 10 from the front edge 2 to the rear edge 3) is determined geometrically. That is, supposing the ratio Tmax/C of maximum wall thickness Tmax of moving blade 10 and blade chordal length C to be about 0.15 or more, the portion of the maximum width 7 side indicated by single-dot chain line in FIG. 8 is corrected so as to be along the solid line curve as indicated by arrow. Supposing the wedge angle WA of the rear edge of the moving blade 10 to be about 10 degrees or less, the portion of the minimum width 8 side indicated by single-dot chain line in FIG. 8 is corrected so as to be along the solid line curve as indicated by arrow. Thus, the design of the moving blade 10 is easy.

Figure 6:
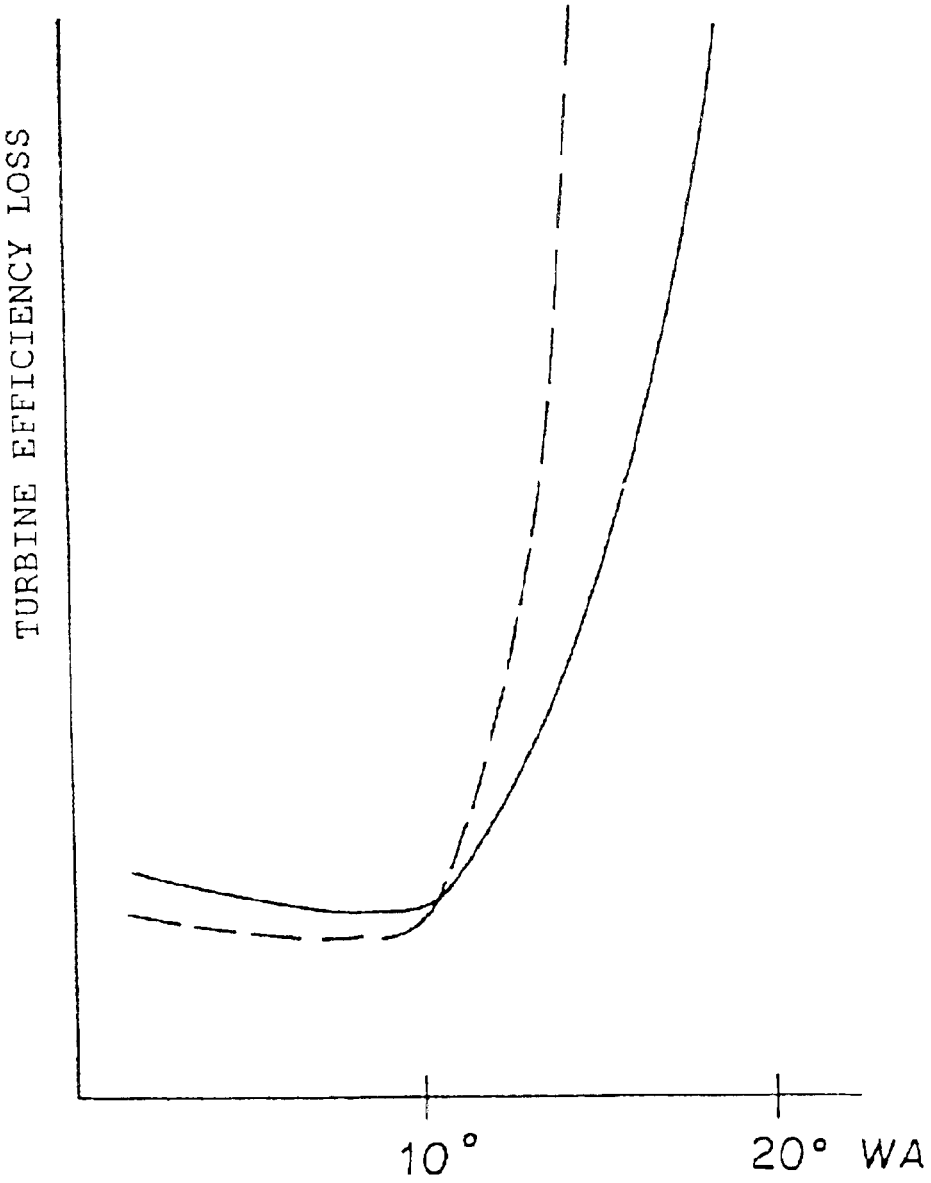
FIG. 6 is a graph showing the relation between the turbine efficiency loss and wedge angle.
Figure 7:
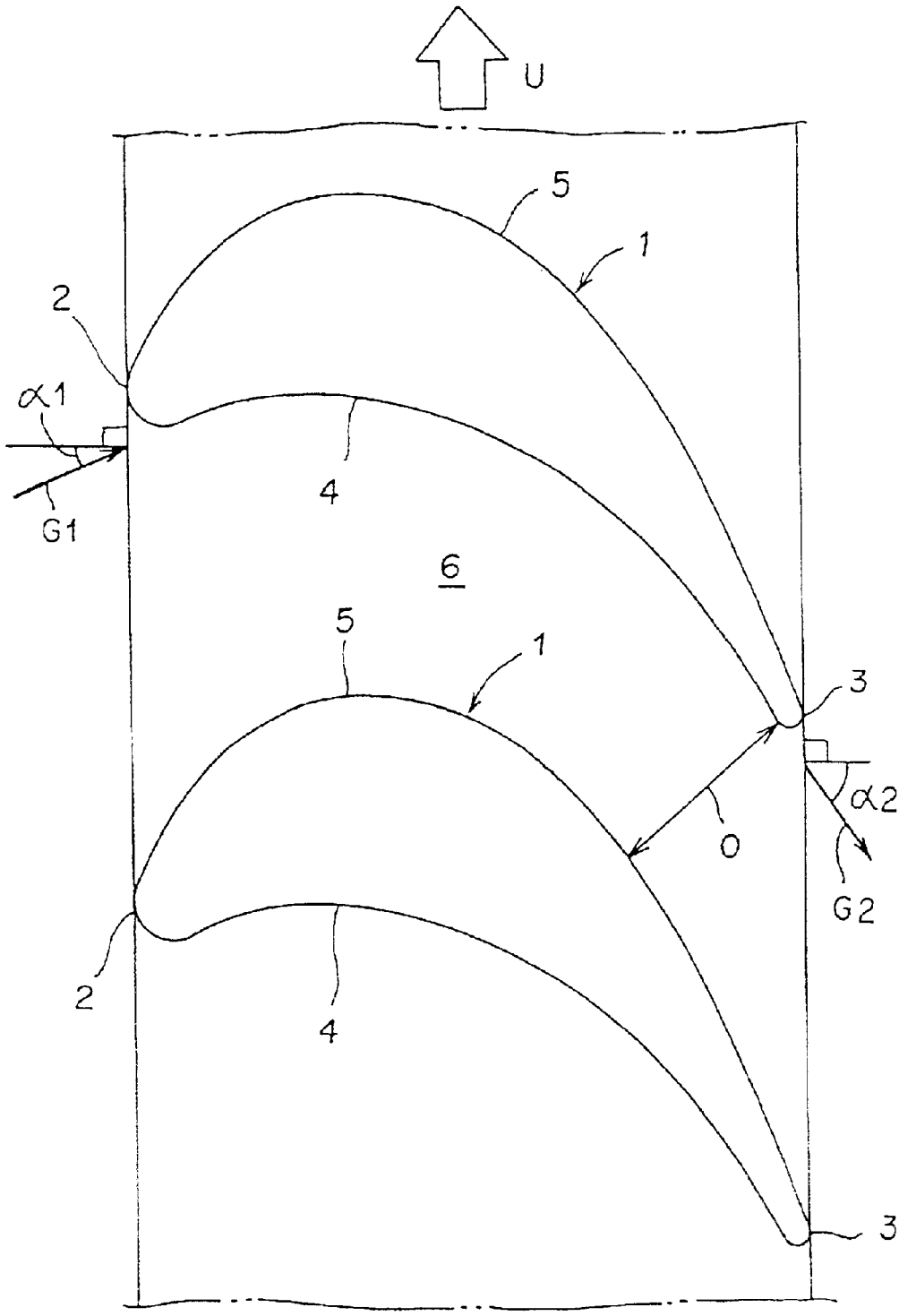
FIG. 7 is an explanatory diagram of influent angle, effluent angle, and throat in the hub of moving blades showing the conventional turbine blades.

Further, as shown in FIG. 6, if the wedge angle WA of the rear edge of the moving blade 10 is more than about 10 degrees, the loss of turbine efficiency is significant, but if it is smaller than about 10 degrees, the loss of turbine efficiency is decreased. In FIG. 6, the broken line shows the moving blade 10 with the effluent angle $\alpha$4 of 60 degrees, and the solid line shows the moving blade 10 with the effluent angle $\alpha$4 of 70 degrees.

The moving blade 10 includes a cooling moving blade of which cooling passage 11 is near the rear edge 3 as shown in FIG. 1. At the rear edge 3 of the cooling moving blade 10, there is an ejection port 12 for ejecting the cooling air (a). One or a plurality of ejection ports 12 are provided from the hub side to the tip side of the rear edge 3 of the cooling moving blade 10.

The cooling moving blade 10 may be composed as shown in FIG. 1. That is, the ratio d/O of the wall thickness (d) of the rear edge 3 of the moving blade 10 and the throat O between the adjacent moving blades 10 is about 0.15 or less.

Figure 4C:
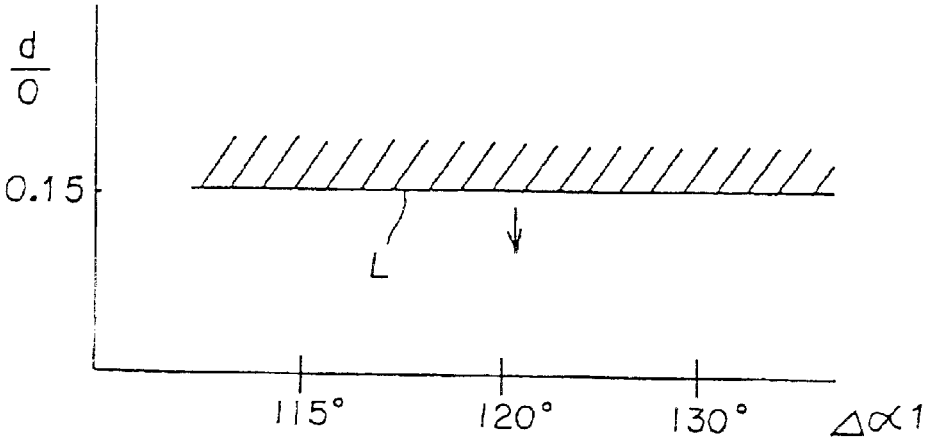
FIG. 4C is a graph showing characteristic of d/O.

The ratio d/O of the wall thickness (d) of the rear edge 3 of the moving blade 10 and the throat O between the adjacent moving blades 10 is about 0.15 or less in an area at the arrow direction side from the straight line L in the characteristic condition shown in the graph in FIG. 4C.

When the characteristic condition is satisfied, even in the case of the cooling moving blade 10 of which cooling passage 11 is near the rear edge 3, the passage 6 indicated by solid line in FIG. 8 (as shown in FIG. 2, the passage 6 gradually decreased in diameters R1, R2, R3, and R4 of inscribed circles 91, 92, 93, and 94 of the belly 4 and back 5 of adjacent moving blades 10 from the front edge 2 to the rear edge 3) is determined geometrically. Thus, the design of the cooling moving blade 10 of which cooling passage 11 is near the rear edge 3 is easy.

Further, in the cooling moving blade 10 of which cooling passage 11 is near the rear edge 3, as shown in FIG. 1, the ratio L1/d of the distance L1 from the cooling passage 11 to the rear edge 3 (regardless of presence or absence of rear edge blow-out; however, the length of ejection port 12 in the presence of rear edge blow-out) and the blade rear edge wall thickness (d) is 2 or less.

When the characteristic condition is satisfied, same as in case of the blade (moving blade 10) set forth in claim 3 of the invention, even in the case of the cooling moving blade 10 of which cooling passage 11 is near the rear edge 3, the passage 6 indicated by solid line in FIG. 8 (as shown in FIG. 2, the passage 6 gradually decreased in diameters R1, R2, R3, and R4 of inscribed circles 91, 92, 93, and 94 of the belly 4 and back 5 of adjacent moving blades 10 from the front edge 2 to the rear edge 3) is determined geometrically. Thus, the design of the cooling moving blade 10 of which cooling passage 11 is near the rear edge 3 is easy.

An explanation if given above about the moving blades. However, this invention is applicable to stationary blades. By applying the invention in the moving blades and stationary blades, the flow of the combustion gases G1, G2 is smooth, and the turbine efficiency is further enhanced.

The conditions in the embodiment (the turning angle $\Delta\alpha$1 of about 115 to 150 degrees, the ratio Tmax/C of maximum wall thickness Tmax and blade chordal length C of about 0.15 or more, the wedge angle WA of the rear edge of about 10 degrees or less, the effluent angle $\alpha$4 of 60 to 70 degrees, the ratio d/O of wall thickness (d) of rear edge 3 and throat O of about 0.15 or less, and the ratio L1/d of the distance L1 from the cooling passage 11 to rear edge 3 and rear edge wall thickness (d) of blade of 2 or less) may be satisfied at least in the hub portion of the moving blades 10.

As explained above, according to the blade of this invention, since the diameter of an inscribed circle of belly side and back side of adjacent blades decreases gradually from the front edge to the rear edge, if the influent angle and effluent angle are set larger, deceleration passage is not formed in the passage between adjacent blades. Therefore, blade suited to a gas turbine of large turning angle, heavy work, and high load can be presented.

Moreover, the turning angle is 115 degrees or more, the ratio of blade maximum wall thickness and blade chordal length is 0.15 or more, and the wedge angle of the rear edge is 10 degrees or less. As a result, the passage in which the diameter of an inscribed circle of belly side and back side of adjacent blades decreases gradually from the front edge to the rear edge is determined geometrically. Therefore, blade can be designed by an optimum design.

Furthermore, in the case of the cooling blade of which cooling passage is near the rear edge, the ratio of wall thickness of rear edge and throat between adjacent blades is 0.15 or less. As a result, even in the case of the cooling blade of which cooling passage is near the rear edge, the passage in which the diameter of an inscribed circle of belly side and back side of adjacent blades decreases gradually from the front edge to the rear edge is determined geometrically. Therefore, it is easy to design the cooling blade of which cooling passage is near the rear edge.

Moreover, in the case of the cooling blade of which cooling passage is near the rear edge, the ratio of the distance from the cooling passage to the rear edge and the wall thickness of rear edge of the blade is 2 or less. As a result, same as in the invention as set forth in claim 3, even in the case of the cooling blade of which cooling passage is near the rear edge, the passage in which the diameter of an inscribed circle of belly side and back side of adjacent blades decreases gradually from the front edge to the rear edge is determined geometrically. Therefore, it is easy to design the cooling blade of which cooling passage is near the rear edge.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A blade, of a gas turbine, having a belly side, a back side, a front edge, and a rear edge, the blade comprising a wide turning angle greater than 120 degrees, wherein diameters of circles inscribing the belly side and the back side of adjacent blades decrease gradually from the front edge to the rear edge wherein a ratio of blade maximum wall thickness and blade chordal length is 0.15 or more, and a wedge angle of the rear edge is 10 degrees or less.

2. The blade according to claim 1, wherein the blade is a cooling blade of which cooling passage is near the rear edge, and the ratio of wall thickness of rear edge and throat between adjacent blades is 0.15 or less.

3. The blade according to claim 1, wherein said blade is a cooling blade of which cooling passage is near the rear edge, and the ratio of the distance from the cooling passage to the rear edge and the wall thickness of rear edge of the blade is 2 or less.

* * * * *